United States Patent [19]

Blackman

[11] Patent Number: 4,763,152

[45] Date of Patent: Aug. 9, 1988

[54] PHOTOGRAPHIC FILM PROCESSING RACK AND METHOD OF ASSEMBLING THE SAME

[75] Inventor: Robert J. Blackman, Rochester, N.Y.

[73] Assignee: Eastman Kodak Company, Rochester, N.Y.

[21] Appl. No.: 72,939

[22] Filed: Jul. 13, 1987

[51] Int. Cl.[4] ..... G03D 3/13

[52] U.S. Cl. ..... 354/321; 354/339; 226/92; 226/170; 226/196

[58] Field of Search ..... 354/320, 321, 322, 338, 354/339, 319; 226/92, 170, 188, 189

[56] References Cited

U.S. PATENT DOCUMENTS

| | | | |
|---|---|---|---|
| 1,177,697 | 4/1916 | Gaumont . | |
| 1,967,889 | 8/1930 | Kitroser | 354/321 |
| 2,853,294 | 12/1957 | Woodcock | 271/2.2 |
| 3,388,653 | 7/1965 | Mayfield | 354/321 |
| 4,295,728 | 10/1981 | Nishimoto | 354/339 |
| 4,613,221 | 9/1986 | Takase et al. | 354/321 |
| 4,666,279 | 5/1987 | Fujita | 354/339 |

*Primary Examiner*—A. A. Mathews

*Attorney, Agent, or Firm*—Roger A. Fields

[57] ABSTRACT

A photographic film processing rack is adapted to be immersed in a processing liquid tank. The processing rack includes four identical rack panels which combine to form two oppositely spaced pairs of mating vertical rack panels, each pair defining between its mating panels a vertical belt path and at least one vertical film process channel. An endless timing belt extends over a drive sprocket at the top of the processing rack, over an idler sprocket at the bottom of the processing rack, and along the vertical belt paths defined by the respective opposite pairs of mating rack panels. The timing belt has inner teeth for positive engagement with the sprockets and outer teeth for positive engagement with a flexible film leader card to which at least one exposed filmstrip is secured. Rotation of the drive sprocket advances the timing belt continuously along the belt paths to pull the exposed filmstrip down a vertical process channel in one of the opposite pairs of rack panels and up a similar channel in the other pair of rack panels. The rack panels, sprockets, and all the other components are supported by four identical end blocks on the four corners of the assembly. The several parts all fit together in an interlocking manner without the use of load-bearing or metallic fasteners.

9 Claims, 15 Drawing Sheets

PHOTOGRAPHIC FILM PROCESSING RACK AND METHOD OF ASSEMBLING THE SAME

CROSS REFERENCE TO A RELATED APPLICATION

Reference is made to commonly assigned, copending patent application Ser. No. 064,420, entitled APPARATUS FOR PHOTOGRAPHIC FILM PROCESSING, and filed June 22, 1987 in the name of Robert J. Blackman and Robert A. Burkovich

BACKGROUND OF THE INVENTION

1. Field of the Invention

This invention relates to the general field of photographic film processing. More particularly, the invention relates to a film processing rack and to a method of assembling the same.

2. Description of the Prior Art

The processing of photographic film involves a sequence of solution-treating steps, such as developing, bleaching, fixing, and rinsing. These steps lend themselves to mechanization by conveying long strips of film sequentially through a series of stations or tanks, each one containing a processing liquid appropriate to the process step at that station.

One type of known processing apparatus is disclosed in U.S. Pat. No. 4,613,221 issued Sept. 23, 1986 to Takase et al. The Takase patent discloses a processing apparatus for conveying a filmstrip through a treating tank by means of a sprocket-driven endless timing belt having spaced projections around its outer periphery. An apertured leader card engaging the projections on the timing belt is attached to the filmstrip to lead the filmstrip through the tank. A guide member located outward of the timing belt and the leader card holds the card in engagement with the belt.

Typically, such known devices are assembled by fasteners, including metallic screws and the like, as in the Takase patent. The chemicals to which the apparatus is subjected require that the metallic parts be constructed of materials, such as titanium, which are inert or resistant to attack by these chemicals. Also, the known devices are complicated to assemble.

THE CROSS-REFERENCED APPLICATION

In the patent application cross-referenced above, there is disclosed a photographic film processor which includes an upstanding processing rack immersed in a processing liquid tank. The rack has two oppositely spaced pairs of mating vertical rack panels, each pair defining between its mating rack panels a vertical belt path and at least one vertical film process channel. An endless timing belt extends over a drive sprocket at the top of the processing rack, over an idler sprocket at the bottom of the processing rack, and along the vertical belt paths defined by the respective opposite pairs of vertical rack panels. The timing belt has inner teeth for engagement with the sprockets and outer teeth for engagement with a flexible film leader card to which at least one exposed filmstrip is secured. Rotation of the drive sprocket advances the timing belt continuously along the vertical belt paths to pull the exposed filmstrip down a vertical film process channel in one of the opposite pairs of rack panels and up a similar channel in the other pair of rack panels. A processing liquid is pumped into a central vertical cavity between the opposite pairs of vertical rack panels and is constrained for positive flow through numerous inlet openings in each inner rack panel at either side of the central cavity. The processing liquid is directed against the emulsion side of successive sections of the filmstrip being pulled along the vertical process channels, and out of corresponding outlet openings in each outer rack panel proximate the walls of the processing tank. Then, the used liquid flows downwardly between each outer rack panel and the tank walls to drain through an outlet port at the tank bottom.

SUMMARY OF THE INVENTION

It is an object of this invention to provide a photographic film processing rack of which the components are easily assembled in an interlocking manner to form an integrated whole.

Another object is to provide a photographic film processing rack which avoids the use of metallic screws and the like for its assembly.

The structure of the invention may be summarized as: a photographic film processing rack comprising: four identical end blocks each having a central journal bearing, including two bottom end blocks disposed with their journal bearings in axial alignment and extending inwardly, and two top end blocks disposed with their journal bearings in axial alignment and extending outwardly; an idler sprocket on an idler shaft rotatably mounted in the journal bearings of the bottom end blocks; a drive sprocket and a power input sprocket on a drive shaft rotatably mounted in the journal bearings of the top end blocks; a timing belt extending over and in positive engagement with the drive sprocket and the idler sprocket; a bottom concave guide member supported by and between the bottom end blocks and forming a partial peripheral enclosure around the idler shaft and the idler sprocket; a top crossover member supported by and between the top end blocks for operative connection to a like pair of end blocks of another processing rack; and four identical vertical rack panels each having an outer face and an inner face and an extended hinge edge, the inner faces of the rack panels each including a central vertical belt clearance slot and a vertical concavity on each side of the belt clearance slot, the rack panels being joined in mating pairs with their inner faces together defining a vertical belt path and a vertical film process channel on each side of the belt path, and the extended hinge edges of the rack panels being in locking engagement with the end blocks.

The method of the invention may be summarized as follows: a method of assembling a photographic film processing rack, comprising the following steps: mounting an idler sprocket on an idler shaft; looping a timing belt over the idler sprocket; placing the idler sprocket and the idler shaft within a bottom concave guide member; placing four identical end blocks, each having a central journal bearing, such that two of the end blocks are bottom end blocks of the assembly and are disposed with their journal bearings in axial alignment and extending inwardly, and two of the end blocks are top end blocks and are disposed with their journal bearings in axial alignment and extending outwardly, then sliding the journal bearings of the bottom end blocks onto respective ends of the idler shaft to cause the bottom end blocks to support the idler shaft and the bottom guide member between them; mounting a drive sprocket on a drive shaft; sliding the journal bearings of the top end blocks onto respestive ends of the drive shaft to cause the top end blocks to support the drive shaft between them; looping the timing belt over the drive sprocket; placing a first of four identical vertical rack panels, each having an outer face and an inner face and an extended hinge edge, in mating engagement with the bottom and top end blocks and between two parallel lengths of the timing belt, with the inner face of the first panel facing one of the belt lengths; placing a second of the rack panels in mating engagement with the bottom and top end blocks and over the first panel, with the inner face of the second panel opposite the inner face of the first panel to sandwich the one belt length between both panels; placing a third of the rack panels in mating engagement with the bottom and top end blocks and opposite the first panel, with the inner face of the third panel facing the other belt length; and placing the fourth of the rack panels in mating engagement with the bottom and top end blocks and over the third panel, with the inner face of the fourth panel opposite the inner face of the third panel to sandwich the other belt length between both panels.

DESCRIPTION OF THE PREFERRED EMBODIMENT

Figure 1:
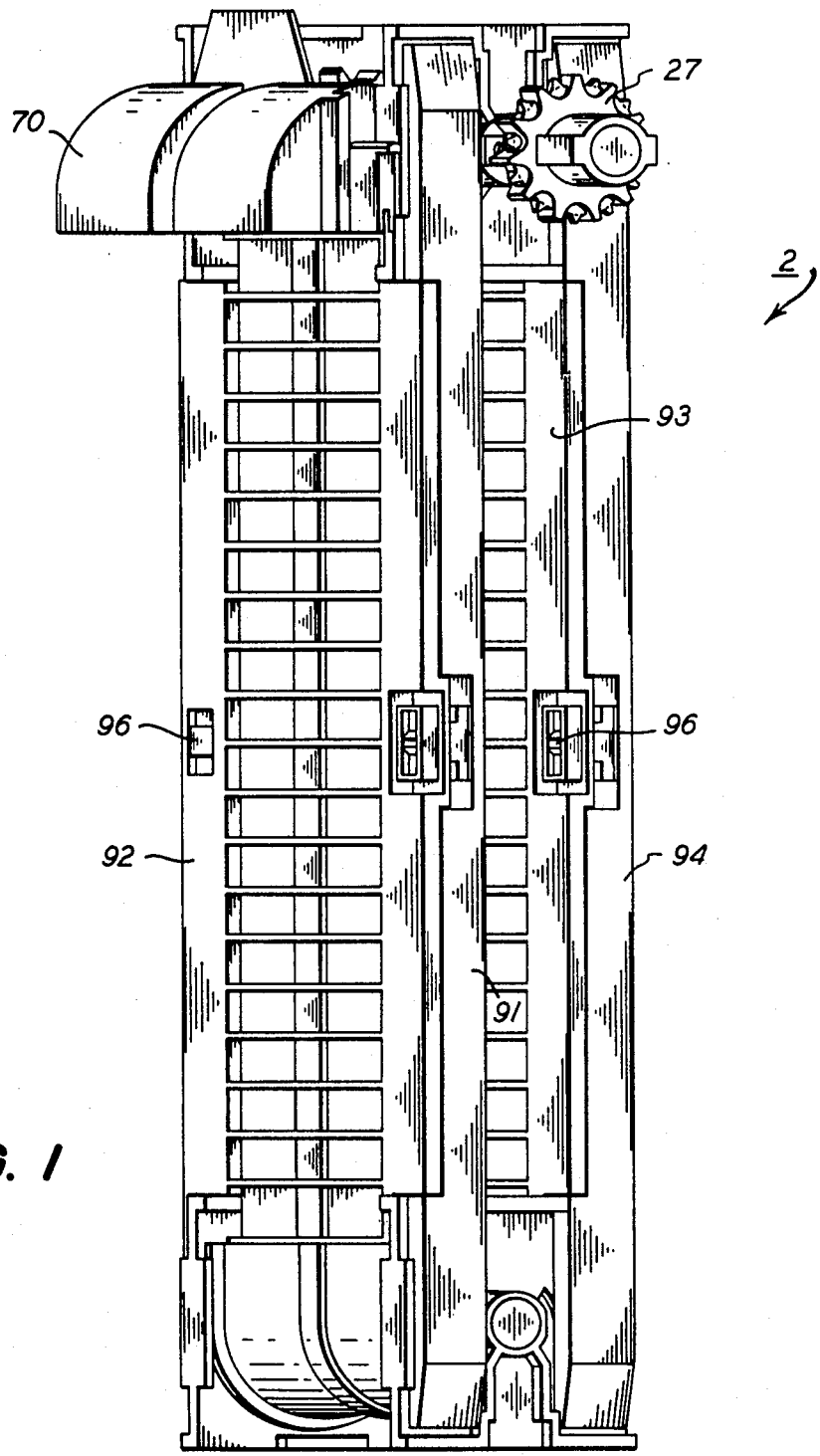
FIG. 1 a perspective view of a fully assembled film processing rack, according to a preferred embodiment of the invention.

Referring to FIG. 1, an assembled film processing rack 2 is depicted in an upright position, which is the position of the rack when mounted in a processing liquid tank, not shown. The processing rack 2 is fully disclosed in the patent application cross-referenced above. That application is incorporated in this one by reference. Briefly, the processing rack 2 has two oppositely spaced pairs of mating vertical rack panels 91,92 and 93,94. Although not shown, each pair of vertical rack panels defines a vertical belt path and at least one vertical film process channel. Moreover, an endless timing belt extends over a drive sprocket at the top of the processing rack, over an idler sprocket at the bottom of the processing rack, and along the vertical belt paths defined by the respective opposite pairs of vertical rack panels. The timing belt has inner teeth for engagement with the sprockets and outer teeth for engagement with a flexible film leader card to which at least one exposed filmstrip is secured. Rotation of the drive sprocket advances the timing belt continuously along the vertical belt paths to pull the exposed filmstrip down a vertical film process channel in one of the opposite pairs of rack panels and up a similar channel in the other pair of rack panels. A processing liquid is pumped into a central vertical cavity between the opposite pairs of vertical rack panels and is constrained for positive flow through numerous inlet openings in each inner rack panel at either side of the central cavity. The processing liquid is directed against the emulsion side of successive sections of the filmstrip being pulled along the vertical process channels, and out of corresponding outlet openings in each outer rack panel proximate the walls of the processing tank. Then, the used liquid flows downwardly between each outer rack panel and the tank walls to drain through an outlet port at the tank bottom.

The foregoing paragraph is only a summary description, intended as an aid to understanding the environment of the invention, in advance of the following detailed description which will begin with a cataloguing of parts.

Figure 2:
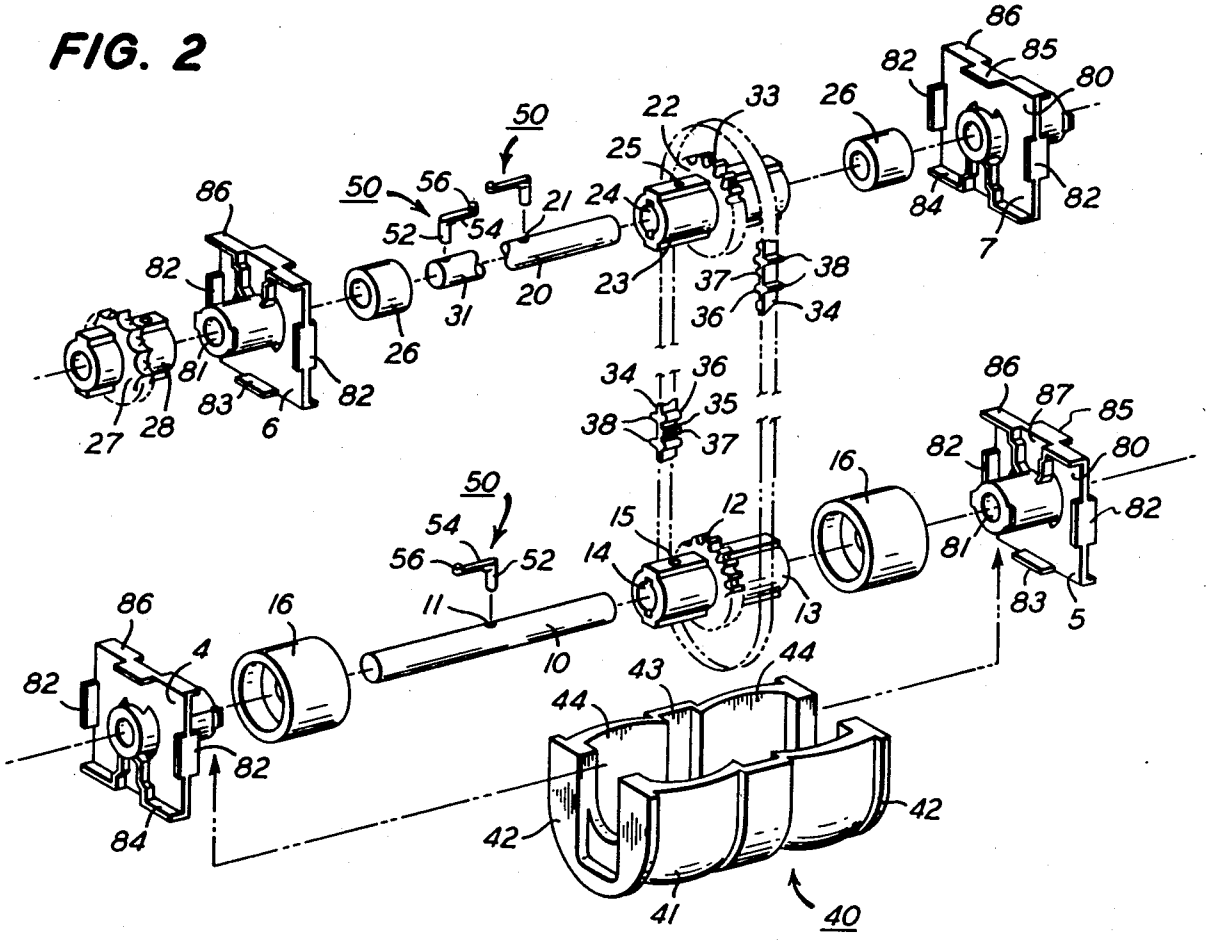
FIG. 2 is a partial exploded view of the processing rack of FIG. 1 showing several of its parts in their respective positions relative to one another.
Figure 3:
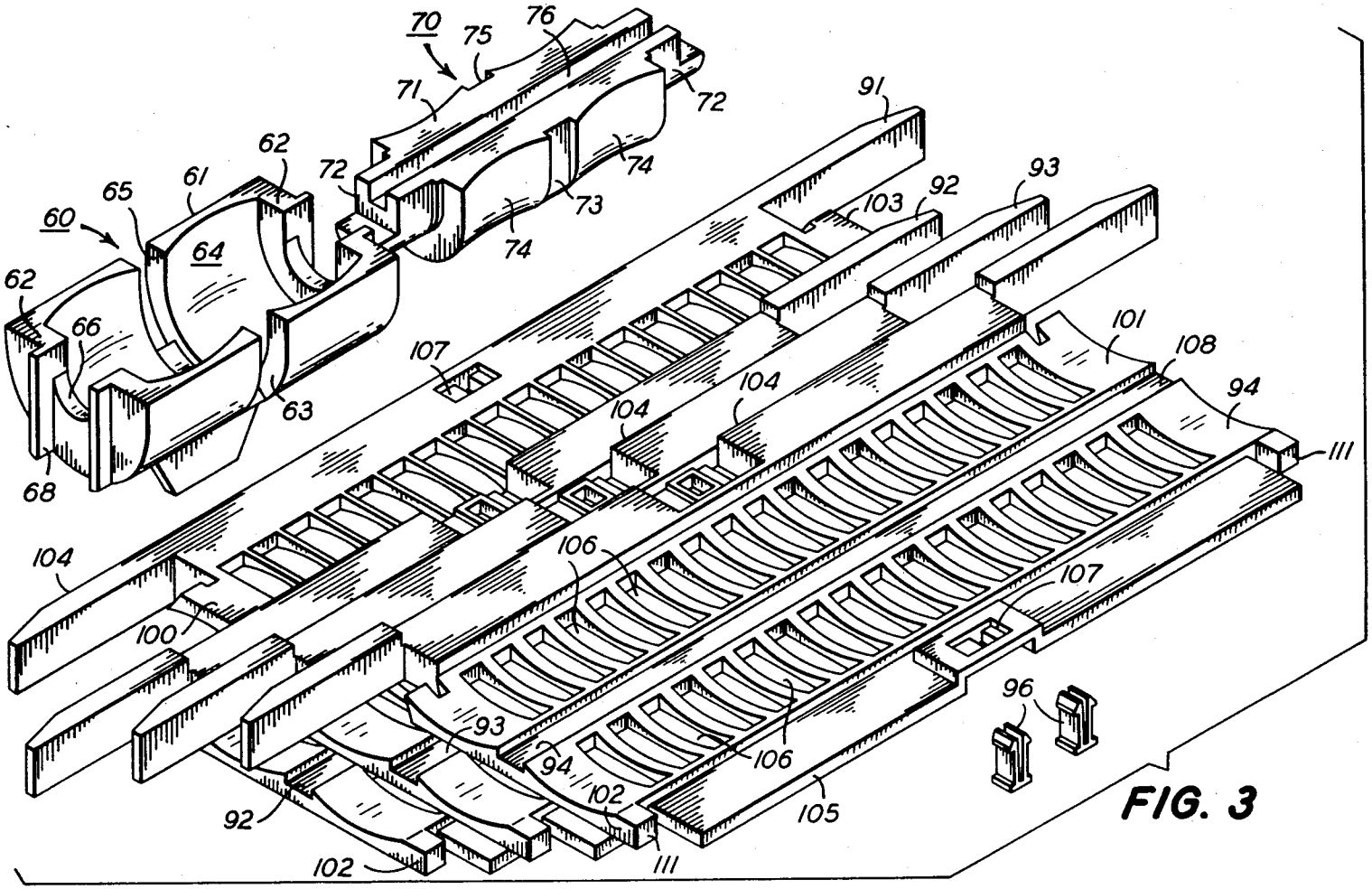
FIG. 3 is a disassembly of parts of the processing rack not shown in FIG. 2, including four rack panels, an outer and an inner top crossover member, and two snap fasteners, these parts to be assembled with those parts shown in FIG. 2.

The component parts of the processing rack 2 are shown in FIGS. 2 and 3. They include:

four identical end blocks 4, 5, 6 and 7:

an idler shaft 10 having a sprocket keyhole 11 midway between its ends;

an idler sprocket 12 having an integral hub 13 formed at each side of the sprocket, and an internal keyway 14 and a keyseat 15 in the hub;

a pair of roller sleeves 16 adapted to slide onto the hub 13 to respective positions at each side of the idler sprocket 12;

a drive shaft 20 having a sprocket keyhole 21 midway between its ends and an end sprocket keyhole 31;

a drive sprocket 22 having an integral hub 23 formed at each side of the sprocket, and an internal keyway 24 and a keyseat 25 in the hub;, a pair of spacer sleeves 26 adapted to slide onto the drive shaft 20 to respective positions adjacent the ends of the hub 23;

a power input sprocket 27 having an integral hub 28, formed at each side of the sprocket, and an internal keyway and a keyseat in the hub, which are not shown;

an endless timing belt 34 having an inner circumferential center groove 35, inner alternately spaced teeth 36 and 37, and outer spaced teeth 38;

a bottom concave guide member 40;

three identical key members 50, each having a spindle 52 for insertion in one of the shaft keyholes 11, 21, and 31, a resilient arm 54 to slide into one of the hub keyways 14 and 24, and a key 56 on the end of the resilient arm to snap into one of the hub keyseats 15 and 25;

a top outer crossover member 60 (FIG. 3);

a top inner crossover member 70 (FIG. 3);

four identical rack panels 91,92, 93 and 94 (FIG. 3); and a pair of snap fasteners 96 (FIG. 3).

Reference is now to FIG. 2. The four end blocks 4–7 are the cornerstones of the structure; that is, they support and lock together all the other parts. In the description which follows, the two end blocks 4 and 5 will be referred to as bottom end blocks, the two end blocks 6 and 7 will be referred to as top end blocks. All of the four end blocks 4, 5, 6 and 7 are identical. They are essentially square plates 80, each including a central shaft bearing or journal bearing 81. It is noted that the bottom end blocks 4 and 5 are positioned with their journal bearings 81 extending inwardly, and the top end blocks 6 and 7 are positioned with their journal bearings 81 extending outwardly. This will account for some differences in the following descriptions of the bottom and top end blocks, despite the fact that they are identical.

Regarding the bottom end blocks 4 and 5, shown in FIG. 2, the upright front and rear edges of each block include two restraining flanges 82 extending both inward and outward of the square plate 80. The bottom edges of each block 4 and 5 include a central inward flange 83 and an outward edge flange 84. The top edges of each block 4 and 5 are the reverse of the bottom edges and include a central outward flange 85 and an inward edge flange 86. Two spaced abutments 87 extend inwardly from each edge flange 86.

Regarding the top end blocks 6 and 7 shown in FIG. 2, the upright front and rear edges of each block include two restraining flanges 82 extending both inward and outward of the square plate 80. The bottom edges of each block 6 and 7 include a central outward flange 83 and an inward edge flange 84. The top edges of each block 6 and 7 are the reverse of the bottom edges and include a central inward flange 85 and an outward edge flange 86. Two spaced abutments 87 extend inwardly from each edge flange 84. Note that the flanges 83, 84, 85 and 86 are the same in both the bottom and top end blocks 4–7; they are described separately, however, because the end blocks themselves are oppositely directed, bottom and top. What is inward for the bottom end blocks 4 and 5 is outward for the top end blocks 6 and 7 and vice versa.

The bottom concave guide member 40 includes a generally U-shaped or semi-cylindrical shaped hollow body 41, with a flange 42 at each end of the hollow body. The body 41 and the two flanges 42 are configured to partially surround the idler shaft 10, the idler sprocket 12, and the two roller sleeves 16. The interior of the body 41 is configured to include a central clearance slot 43 for the timing belt 34 and a bowl-like concavity 44 at each side of the central clearance slot for effecting a 180 degree or U-turn of two film process channels 110 to be described in the next paragraph.

Figure 19:
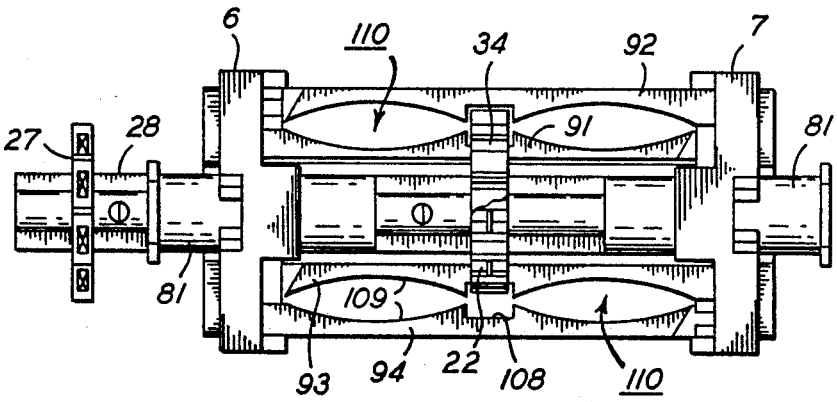

Reference is now to FIGS. 3 and 19. The four rack panels 91, 92, 93 and 94 as described above are identical. Each panel is essentially an elongated flat plate having an outer face 100, an inner face 101, two opposite end edges 102 and 103, a hinge-like longitudinal edge 104, and a closure longitudinal edge 105. The outer and inner faces 101 and 101 of each panel include a number of common wall openings 106 in parallel vertical arrays. Adjacent the closure edge 105 of each panel there is provided a lock aperture 107 for receiving a snap fastener 96 to engage one panel with another to form a mating pair of rack panels (91, 92 and 93, 94 in FIG. 19). The end edges 102 and 103 of each panel include respective tabs 111. The inner face 101 of each panel includes a central vertical belt clearance slot 108 and a vertical concavity 109 at either side of the central clearance slot; these vertical concavities are in line with and correspond respectively with the parallel arrays of openings 106. The vertical concavities 109 of one panel together with the vertical concavities of a mating panel form the respective vertical film process channels 110 (see FIG. 19).

Figure 20:
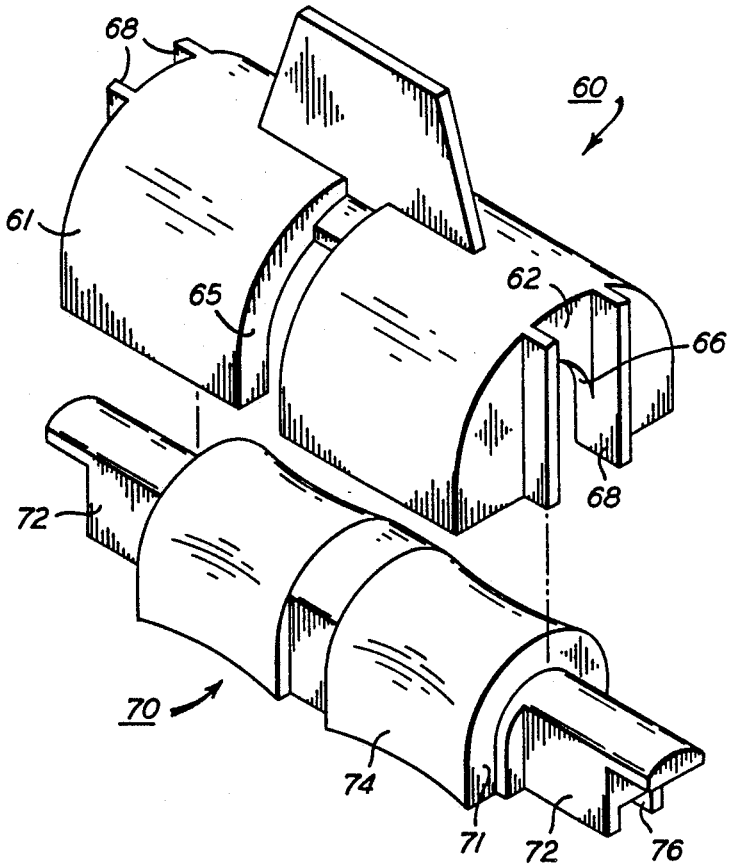

The top outer crossover member 60, shown in FIGS. 3 and 20, is somewhat similar to the bottom guide member 40. The crossover member 60 includes a generally U-shaped or semi-cylindrical shaped hollow body 61, with an inward radial flange 62 at each end of the hollow body forming insertion slots 66. A pair of parallel projections 68 extend outward from the respective end flanges 62, one on each side of an insertion slot 66. The interior of the body 61 is configured to include a central clearance slot 63, 65 for the timing belt 34 and a bowl-like concavity 64 on each side of the central clearance slot.

The top inner crossover member 70, shown in FIGS. 3 and 20, includes a generally semi-cylinderical shaped body 71 which fits within the outer crossover member 60. The crossover member 70 also includes an open axial slot 76 extending along its length. The radially inner portion of the body 71 is longer than the peripheral portion of that body; that is, it extends beyond the body at each end to form two extensions 72. These extensions 72 fit-within and through the insertion slots 66 formed by the flanges 62 of the outer crossover member 60, the inner crossover member 70 being thereby restrained from rotation within the outer crossover member. The inner crossover member 70 is configured to include a central clearance slot 73, 75 for the timing belt 34, and an incurved contour 74 on each side of the central clearance slot. The mating outer and inner crossover members 60 and 70, by virtue of their incurved concavities 64 and incurved contours 74, respectively, together form a 180 degree or U-turn continuation of the respective film process channels 110 formed by the vertical concavities 109 of the mating pairs of rack panels 91,92 and 93,94.

The timing belt 34 as described before includes an inner circumferential center groove 35, inner teeth 36 and 37, and outer teeth 38. The inner teeth 36 and 37 are alternately spaced around the inside of the belt, the teeth 36 being higher than the teeth 37. The inner teeth 36 are in registry with the outer teeth 38. Similarly, the idler and drive sprockets 12 and 22 have teeth with alternating depths between them to correspond with the alternating height of the inner teeth 36 and 37 on the belt 34. This is to insure proper placement of the belt 34 on the sprockets 12 and 22, whereby the timing belt for first processing rack 2 will be spatially syncrhonized with a timing belt on a next successive processing rack.

The several components having been described, their assembly will now be described in sequence with reference to FIGS. 4 through 21.

Figure 4:
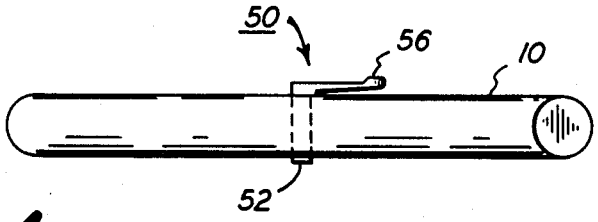
FIGS. 4–21 show sequentially the step-by-step assembly of the processing rack.

In FIG. 4, a key member 50 is mounted by means of its spindle 52 in the keyhole of the idler shaft 10.

Figure 5:
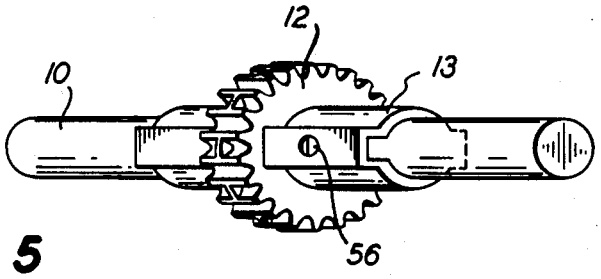

In FIG. 5, the idler sprocket 12 is slipped onto the idler shaft 10 and over the key member 50. Then, the key 56 snaps into engagement with the sprocket hub 13.

Figure 6:
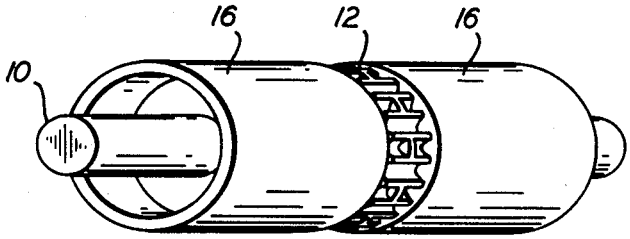

In FIG. 6, the two roller sleeves 16 are slid onto the hub 13 of the idler sprocket 12.

Figure 7:
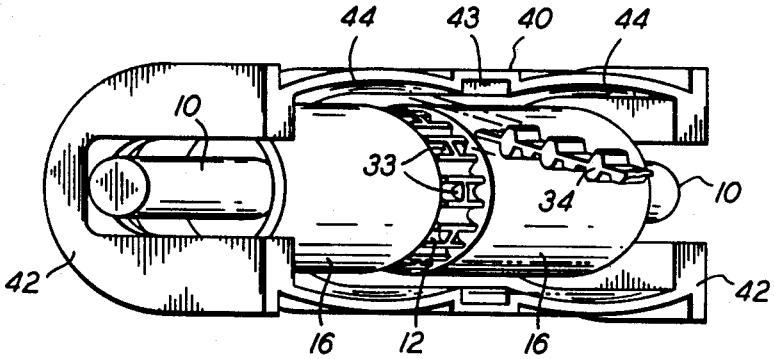

In FIG. 7, the timing belt 34 is looped over the idler sprocket 12, and the foregoing components are then placed within the bottom concave guide member 40. Note that the idler sprocket 12 has a plurality of webs 33 between its teeth to prevent the belt 34 from sliding off the sprocket. The drive sprocket 22 has similar webs 33.

Figure 8:
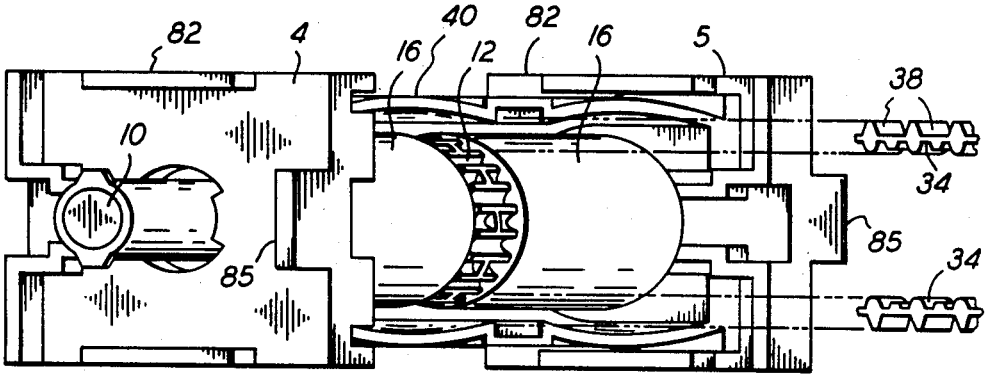

In FIG. 8, the bottom end blocks 4 and 5 are placed, one on each end of the idler shaft 10. The end flanges 42 of the bottom concave guide member 40 fit within the upright restraining flanges 82, and rest upon the central inward flanges 83 of the bottom end blocks 4 and 5.

Figure 9:
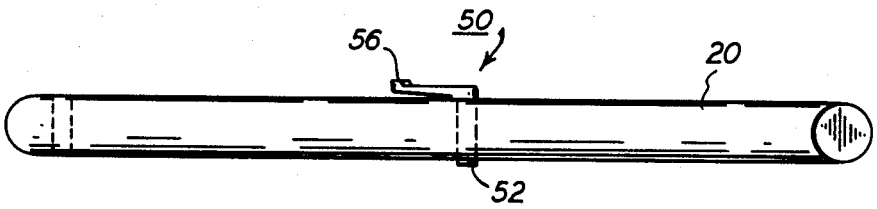

In FIG. 9, a key member 50 is mounted by means of its spindle 52 in the keyhole of the drive shaft 20.

Figure 10:
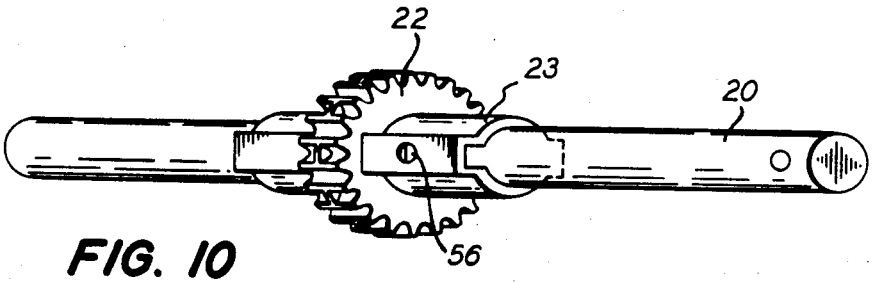

In FIG. 10, the drive sprocket 22 is slipped onto the drive shaft 20 and over the key member 50. Then, the key 56 snaps into engagement with the sprocket hub 23.

Figure 11:
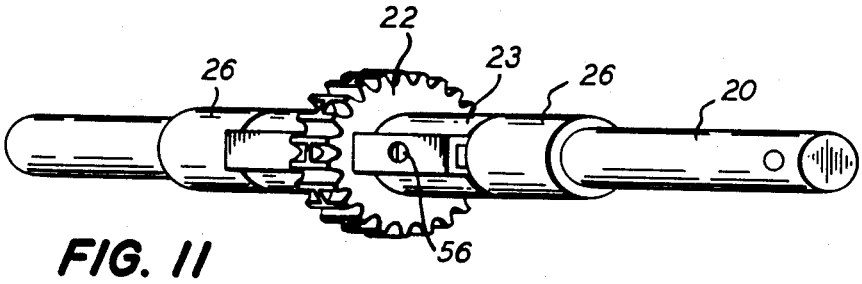

In FIG. 11, the spacer sleeves 26 are slid onto the drive shaft 20, one at each side of the drive sprocket 22.

Figure 12:
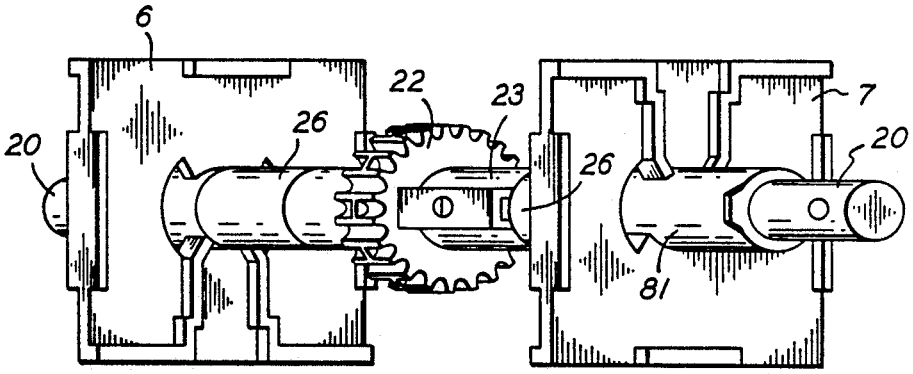

In FIG. 12, the top end blocks 6 and 7 are placed, one on each end of the drive shaft 20, with their journal bearings 81 extending outwardly.

Figure 13:
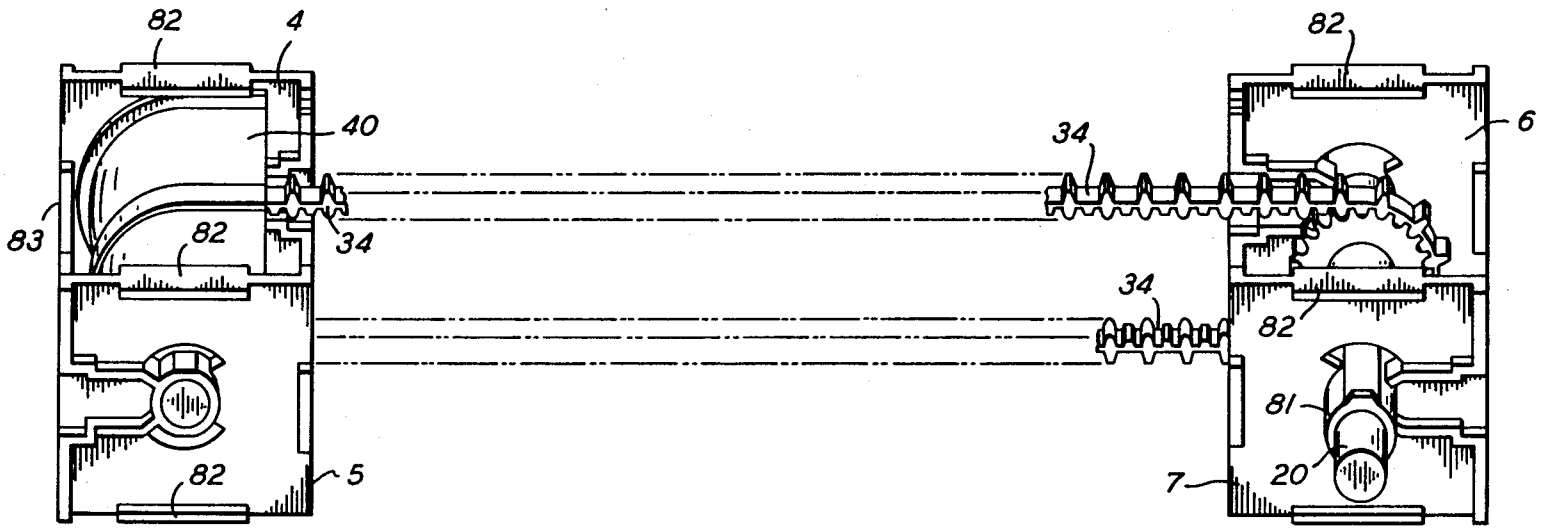

In FIG. 13, the drive subassembly of FIG. 12 (shown at the right) is positioned within the loop of the timing belt 34 remote from the idler subassembly (shown at the left). The apparatus thus far assembled is shown in FIG. 13 lying on its back.

Figure 14:
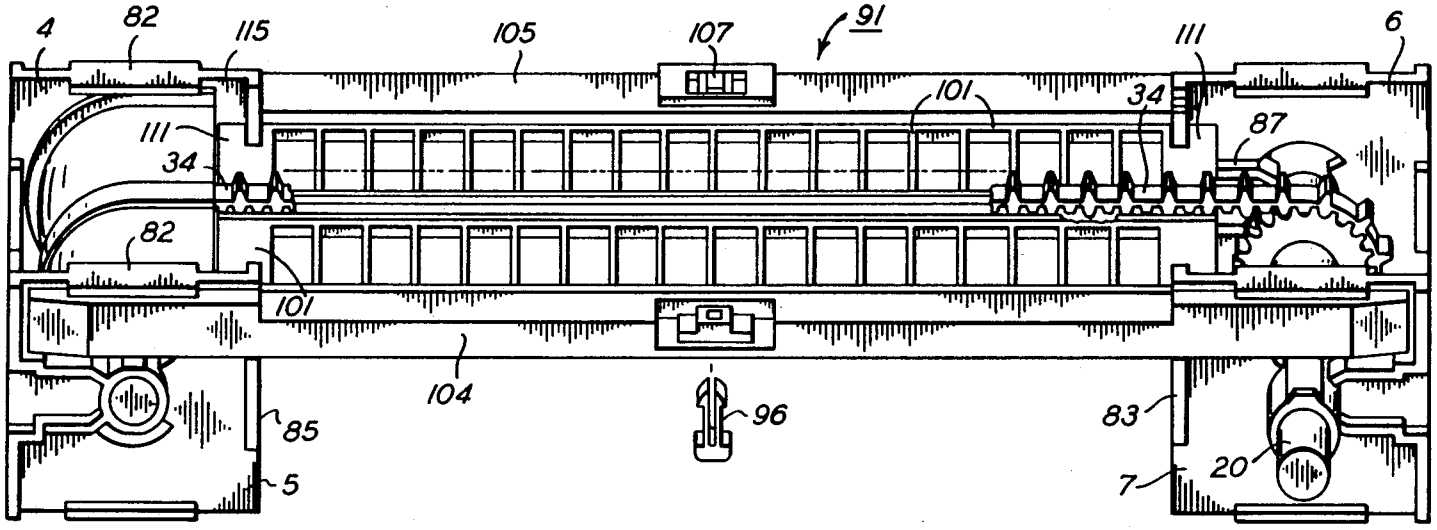

In FIG. 14, one of the rack panels 91 is put in place between the bottom end blocks 4,5 and the top end blocks 6,7. This first of the rack panels to be put in place can be inserted from either side or direction. The rack panel 91 is positioned between two parallel lengths of the timing belt 34, with its inner face 101 immediately beneath (i.e., facing) the illustrated length. The hinge-like longitudinal edge 104 of the rack panel 91 rests on the outward flange 85 of the bottom end block 5 and on the outward flange 83 of the top end block 7. The tabs 111 on the ends of the closure edge 105 of the rack panel 91 rest on the abutments 87 on the inner walls of the end blocks.

Figure 15:
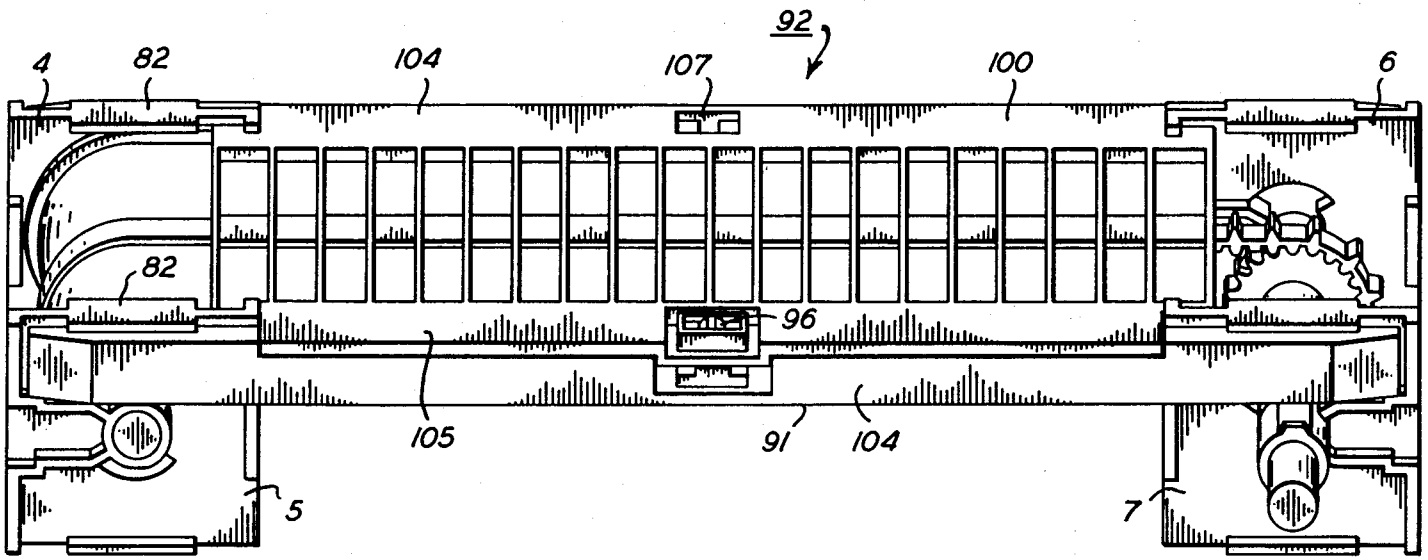

In FIG. 15, the second rack panel 92 is placed over the first (inner) rack panel 91, thereby sandwiching the illustrated leg of the timing belt 34 between both rack panels (FIG. 19). In this case (as compared to FIG. 14), the hinge-like longitudinal edge 104 of the rack panel 92 is on the far side, and it rests on the outward flanges 85 and 83 on the far side of the bottom and top end blocks 5 and 7, respectively. The outer face 100 of the rack panel 92 is showing; its inner face is directed toward that of the rack panel 91. The rack panel 92 is swung down and the snap fastener 96 fastens its closure edge 105 to the hinge-like edge 104 of the underlying panel 91. Thus, the rack panels 91 and 92 form a mating pair.

Figure 16:
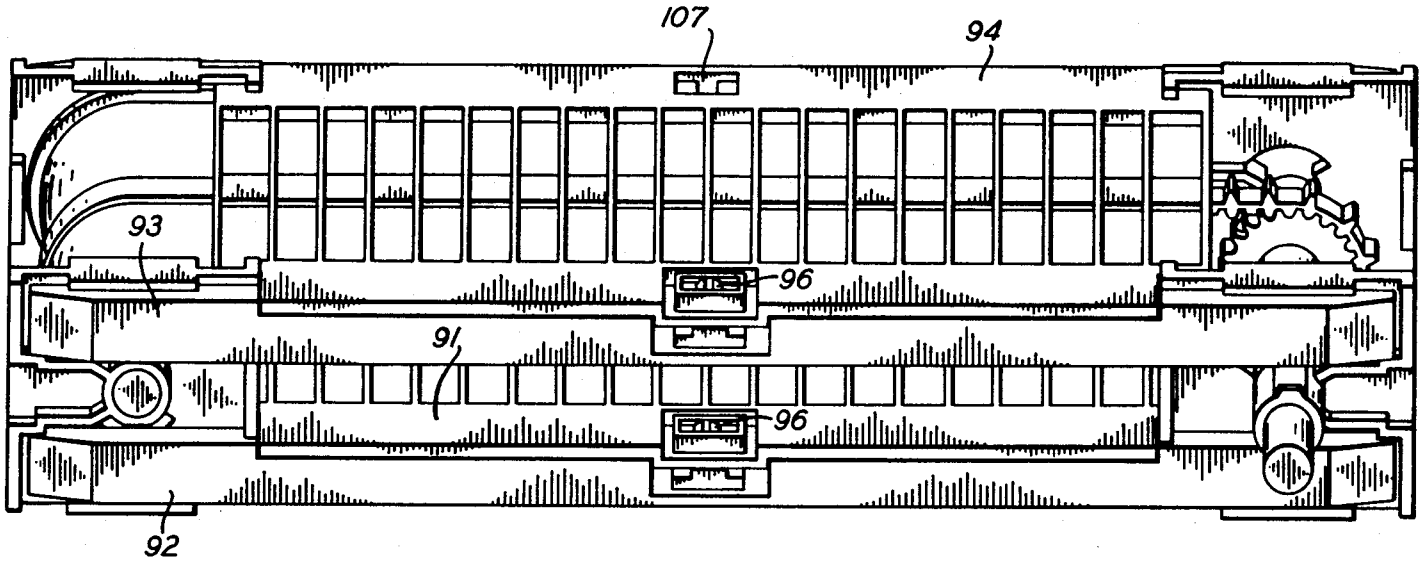

The entire unit thus far assembled is turned over and the steps of FIGS. 14 and 15 are repeated with the third rack panel 93 put in place as an inner panel, followed by the fourth rack panel 94 placed over the third rack panel and fastened to it. FIG. 16 shows the assembly at this stage.

Figure 17:
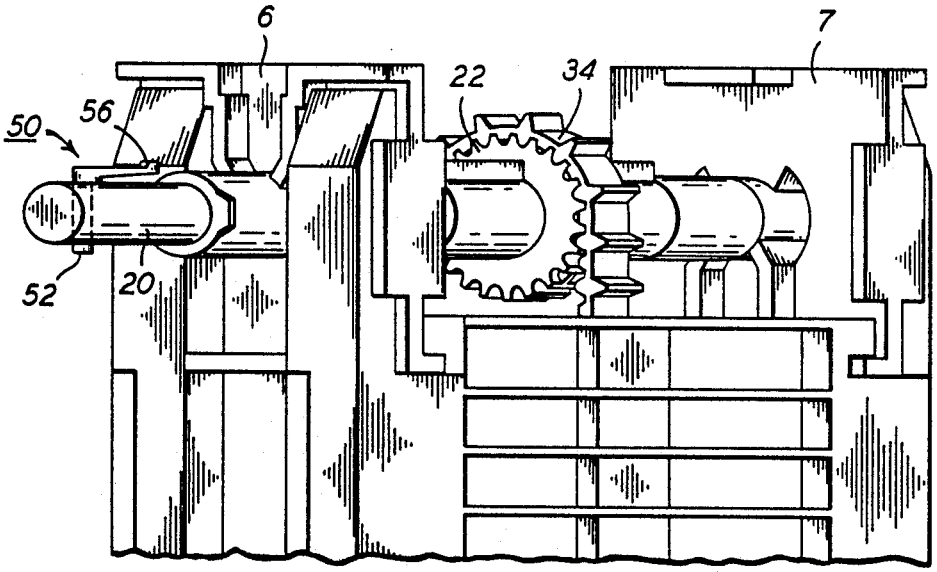

In FIG. 17, the entire assembly (so far) is now standing in its normal upright position on its bottom end blocks. A key member 50 is mounted by means of its spindle 52 in the end keyhole of the drive shaft 20.

Figure 18:
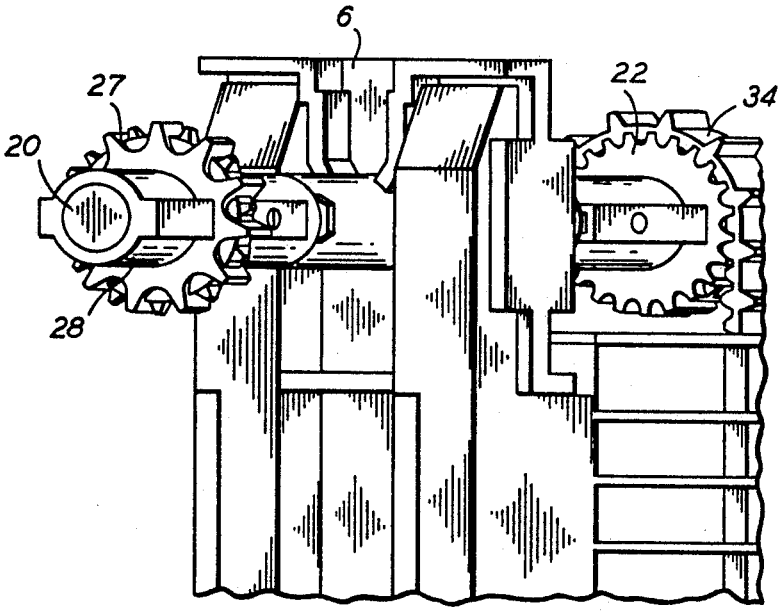

In FIG. 18, the power input sprocket 27 is slipped onto the drive shaft 20 and over the key member 50. Then, the key 56 snaps into engagement with the hub 28 of the power input sprocket 27.

FIG. 19 is a top view of the assembly at this stage. It shows the four vertical film process channels 110 and the two belt clearance slots 108 formed by the mating pairs of rack panels 91,92 and 93,94.

In FIG. 20, the inner crossover member 70 is placed within the outer crossover member 60.

Figure 21:
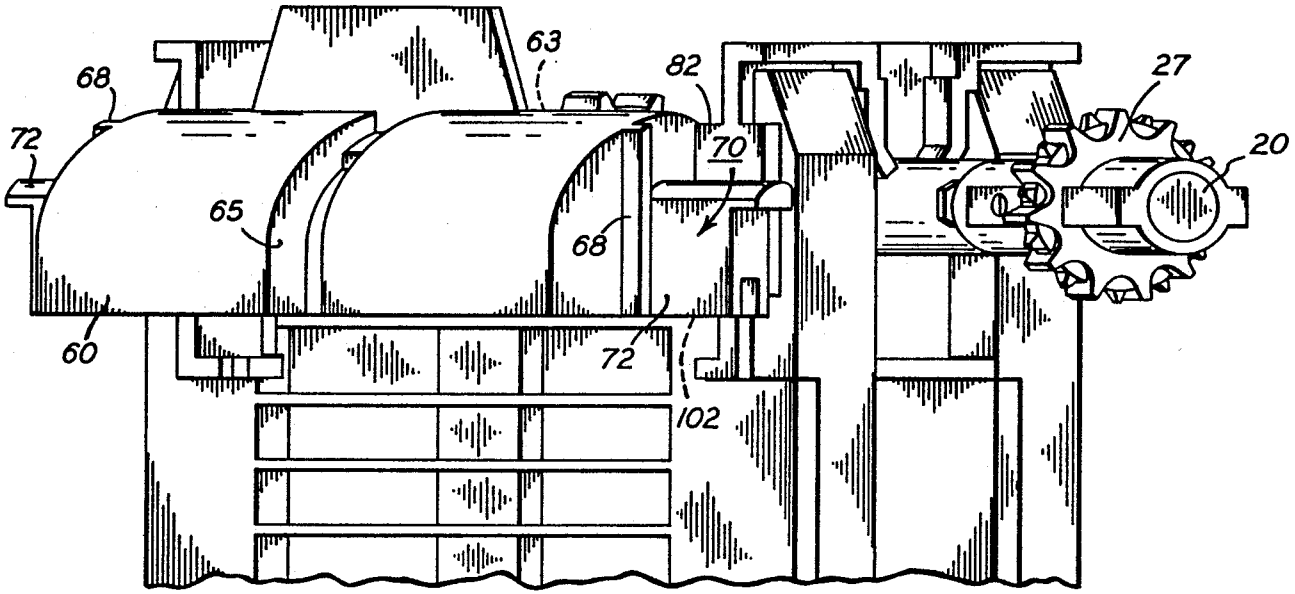

In FIG. 21, the two crossover members 60 and 70 are together set in place on the top end blocks 6 and 7. The axial projections 68 of the crossover member 60 fit within the upright restraining flanges 82 of the top end blocks 6 and 7, which thereby hold the crossover member 60 in place. The inner crossover member 70 rests with one of its edges atop the end edge 102 of the adjacent outer rack panel. The extensions 72 of the inner crossover member are adapted to rest on the side edges of a process tank in which the rack is placed for operation. The axial slot 76 of the inner crossover member rests over the adjoining rear and front edges of an adjacent tank. Thus, the processing rack 2 is held in place relative to the two tanks. FIG. 20 is helpful to show some of these details. The crossover members 60 and 70 connect in the same way with a second processing rack (not shown) in the next adjacent tank, thereby forming a continuous film process path between successive racks and tanks.

Figure 22:
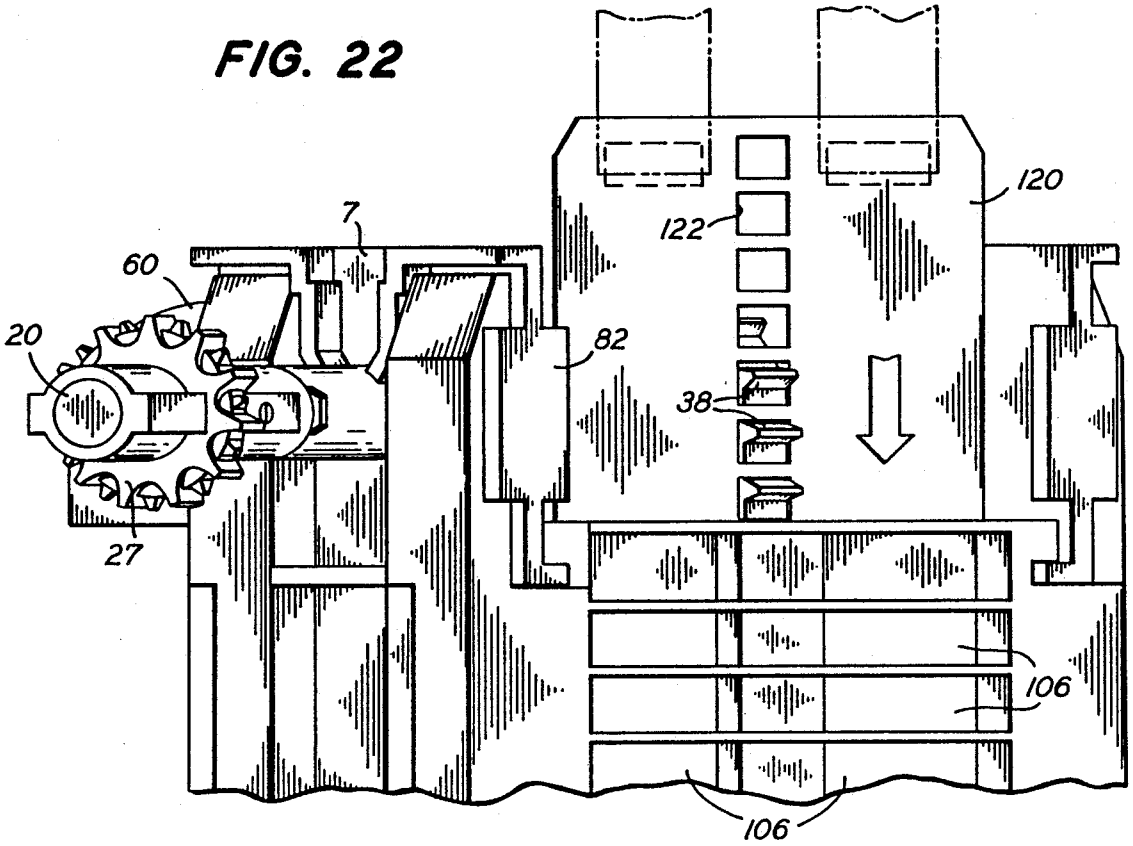
FIGS. 22 and 23 illustrate the operation of the processing rack in moving a film leader card and an attached filmstrip along a film process path defined by the processing rack.
Figure 23:
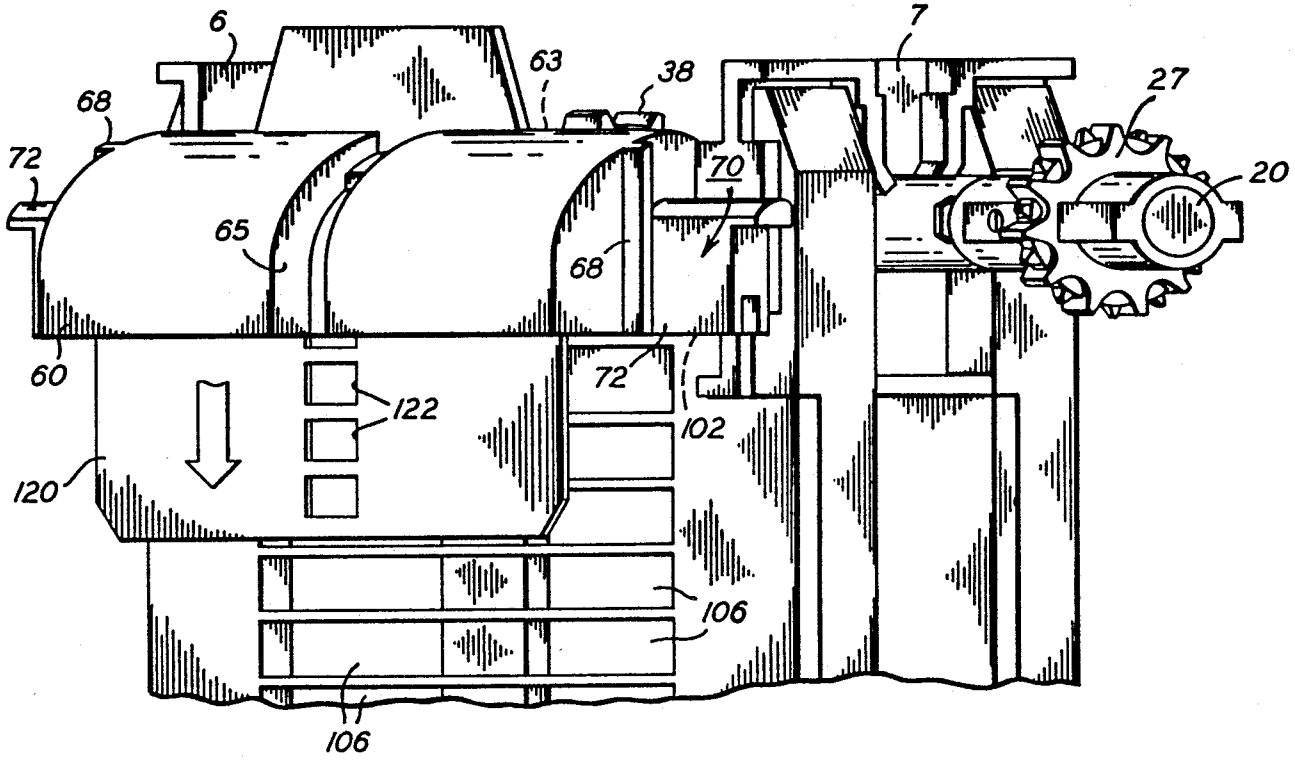

The operation of the film processing rack 2 will now be described with reference to FIGS. 22 and 23. A film leader card 120, shown in FIG. 22, is a thin flexible synthetic resin sheet having a series of square holes 122 spaced along its long axis. Photographic film, represented in phantom lines, is secured to the leader card by butt splicing or other bonding means. The square holes 122 of the leader card engage the outer teeth 38 of the timing belt 34 which thus drives the leader and the attached film through the processing rack. The leader card and timing belt stay in positive engagement by the fact that the outer teeth 38 of the belt extend through the leader and beyond it into the clearance slots 108 in the outer rack panels. The attached parallel film strips are drawn through the processing rack, down through the front process channels 110, through the bottom guide member 40, up through the rear process channels 110, and into and between the top crossover members 60 and 70 from which it emerges (FIG. 23) and enters a second processing rack in the next successive process tank.

Simultaneously with the travel of the leader and film through a processing rack 2, the fluid appropriate to that process station is pumped into the tank. The fluid enters the processing rack primarily in the central cavity between the front pair of rack panels 93, 94 and the rear pair of rack panels 91, 92. It then flows outwardly, front and rear, through the several wall openings 106 in the panels, into and through the process channels 110 for contact with the film strips, and then generally downward along the outer faces of the front and rear panel pairs to an outlet port at the bottom of the tank.

The film strips are attached to the leader card such that their emulsion sides face inwardly of the rack, that is, toward the inner panels 91 and 93.

Power input sprocket 27 is operatively connected to a drive chain or belt, not shown, which imparts motive power to the system.

The several parts of the processing rack assembly herein described are all of polymeric materials, with no metallic parts or fasteners. The structure is firmly held together by interlocking of its various members as an integrated unit.

The invention has been described with reference to a preferred embodiment. However, it will be appreciated that variations and modifications can be effected within the ordinary skill in the art without departing from the scope of the invention.

I claim:

1. A photographic film processing rack comprising:

four identical end blocks each having a central journal bearing, including two bottom end blocks disposed with their journal bearings in axial alignment and extending inwardly, and two top end blocks disposed with their journal bearings in axial alignment and extending outwardly;

an idler sprocket on an idler shaft rotatably mounted in said journal bearings of said bottom end blocks;

a drive sprocket and a power input sprocket on a drive shaft rotatably mounted in said journal bearings of said top end blocks;

a timing belt extending over and in positive engagement with said drive sprocket and said idler sprocket;

a bottom concave guide member supported by and between said bottom end blocks and forming a partial peripheral enclosure around said idler shaft and said idler sprocket;

a top crossover member supported by and between said top end blocks for operative connection to a like pair of end blocks of another processing rack; and four identical vertical rack panels each having an outer face and an inner face and an extended hinge edge, the inner faces of said rack panels each including a central vertical belt clearance slot and a vertical concavity on each side of said belt clearance slot, said rack panels being joined in mating pairs with their inner faces together defining a vertical belt path and a vertical film process channel on each side of said belt path, and said extended hinge edges of the rack panels being in locking engagement with said end blocks.

2. A photographic film processing rack comprising:

four identical end blocks each having a central journal bearing, including two bottom end blocks disposed with their journal bearings in axial alignment and extending inwardly, and two top end blocks disposed with their journal bearings in axial alignment and extending outwardly;

an idler shaft rotatably mounted in said journal bearings of said bottom end blocks, and an idler sprocket mounted for rotation with said idler shaft;

a drive shaft rotatably mounted in said journal bearings of said top end blocks, and a drive sprocket mounted for rotation with said drive shaft;

a power input sprocket fixed to said drive shaft to impart rotational driving force thereto;

a timing belt extending over and in operative engagement with said drive sprocket and said idler sprocket, said timing belt having inner teeth for synchronous engagement with said sprockets, and outer teeth;

a bottom concave guide member supported by and between said bottom end blocks and forming a partial peripheral enclosure around said idler shaft and said idler sprocket;

a top crossover member supported by and between said top end blocks for operative connection to a like pair of end blocks of another processing rack; and four identical vertical rack panels each having an outer face and an inner face and an extended hinge edge, the inner faces of said rack panels each including a central vertical belt clearance slot and a vertical concavity on each side of said belt clearance slot, said rack panels being joined in mating pairs with their inner faces together defining a vertical belt path and a vertical film process channel on each side of said belt path, and said extended hinge edges of the rack panels being in locking engagement with said end blocks.

3. A method of assembling a photographic film processing rack, said method comprising the following steps:

mounting an idler sprocket on an idler shaft;

looping a timing belt over said idler sprocket;

placing said idler sprocket and said idler shaft within a bottom concave guide member;

placing four identical end blocks, each having a central journal bearing, such that two of said end blocks are bottom end blocks and are disposed with their journal bearings in axial alignment and extending inwardly, and two of said end blocks are top end blocks and are disposed with their journal bearings in axial alignment and extending outwardly, then sliding the journal bearings of said bottom end blocks onto respective ends of said idler shaft to cause said bottom end blocks to support said idler shaft and said bottom guide member between them;

mounting a drive sprocket on a drive shaft;

sliding the journal bearings of said top end blocks onto respective ends of said drive shaft to cause said top end blocks to support said drive shaft between them;

looping said timing belt over said drive sprocket;

placing a first of four identical vertical rack panels, each having an outer face and an inner face and an extended hinge edge, in mating engagement with said bottom and top end blocks and between two parallel lengths of said timing belt, with the inner face of said first panel facing one of said belt lengths;

placing a second of said rack panels in mating engagement with said bottom and top end blocks and over said first panel, with the inner face of said second panel opposite the inner face of said first panel to sandwich said one belt length between both panels;

placing a third of said rack panels in mating engagement with said bottom and top end blocks and opposite said first panel, with the inner face of said third panel facing the other belt length; and placing the fourth of said rack panels in mating engagement with said bottom and top end blocks and over said third panel, with the inner face of said fourth panel opposite the inner face of said third panel to sandwich said other belt length between both panels.

4. A method of assembling a photographic film processing rack, said method comprising the following steps:

a. mounting an idler sprocket in locking engagement with an idler shaft;

b. looping a timing belt over said idler sprocket;

c. placing said idler sprocket and idler shaft within a bottom concave guide member;

d. placing four identical end blocks, each having a central journal bearing, such that two of said end blocks are bottom end blocks and are disposed with their journal bearings in axial alignment and extending inwardly, and two of said end blocks are top end blocks and are disposed with their journal bearings in axial alignment and extending outwardly, then sliding the journal bearings of said bottom end blocks onto respective ends of said idler shaft to cause said bottom end blocks to support said idler shaft and said bottom guide member between them;

e. mounting a drive sprocket in locking engagement with a drive shaft;, f. sliding the journal bearings of said top end blocks onto respective ends of said drive shaft to cause said top end blocks to support said drive shaft between them;

g. looping said timing belt over said drive sprocket;

h. placing a first of four identical vertical rack panels, each having an outer face and an inner face and an extended hinge edge, in mating engagement with said bottom and top end blocks and between two parallel lengths of said timing belt, with the inner face of said first panel facing one of said belt lengths;

i. placing a second of said rack panels in mating engagement with said bottom and top end blocks and over said first panel, with the inner face of said second panel opposite the inner face of said first panel to sandwich said one belt length between both panels;

j. placing a third of said rack panels in mating engagement with said bottom and top end blocks and opposite said first panel, with the inner face of said third panel facing the other belt length:

k. placing the fourth of said rack panels in mating engagement with said bottom and top end blocks and over said third panel, with the inner face of said fourth panel opposite the inner face of said third panel to sandwich said other belt length between both panels; and l. mounting a power input sprocket in locking engagement with said drive shaft.

5. A method as recited in claim 4, further comprising the following steps:

prior to step "a" mounting a key member to said idler shaft to provide the locking engagement to step "a"; and prior to each of steps "e" and "l", mounting a key member to said drive shaft to provide mounting a key member to said drive shaft to provide the locking engagements of steps "e" and "l" respectively.

6. A method as recited in claim 4, further comprising the following steps:

prior to step "c", sliding a roller sleeve on said idler shaft on each side of idler sprocket; and prior to step "f", sliding a spacer sleeve on said drive shaft on each side of said drive sprocket.

7. A method as recited in claim 4, further comprising the following step:

m. mounting a top crossover member to and between said top end blocks for operative connection to a like pair of end blocks of a like processing rack.

8. An assemblage of parts for constructing a film processing rack, said assemblage comprising:

four identical rack panels having integral respective means for mating them together in two pairs, said rack panels to constitute each of said pairs including complementally shaped means for defining between the two panels to form a pair a belt clearance path for an endless timing belt and at least one film process channel for a filmstrip;

four identical end blocks having integral respective means for engaging said rack panels to support them as said pairs in oppositely spaced relation; and an endless timing belt.

9. An assemblage of parts for constructing a film processing rack, said assemblage comprising:

four identical rack panels having integral respective means for mating them together in two pairs and respective inner faces, said rack panels to constitute each of said pairs including at their inner faces a central belt clearance slot and a film processing concavity at either side of said central slot such that when two panels to form a pair are mated together as a pair their respective slots define a belt clearance path and their respective concavities form a film process channel; and four identical end blocks having integral respective means for engaging said rack panels to support them as said pairs in oppositely spaced relation.

* * * * *